US008905230B2

(12) United States Patent
Smith

(10) Patent No.: US 8,905,230 B2
(45) Date of Patent: Dec. 9, 2014

(54) GOLF BAG WITH STRAP-RECEIVING CHANNEL

(71) Applicant: Callaway Golf Company, Carlsbad, CA (US)

(72) Inventor: Brian S. Smith, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 11 days.

(21) Appl. No.: 13/761,794

(22) Filed: Feb. 7, 2013

(65) Prior Publication Data

US 2014/0061076 A1 Mar. 6, 2014

Related U.S. Application Data

(60) Provisional application No. 61/694,393, filed on Aug. 29, 2012.

(51) Int. Cl.
*A63B 55/00* (2006.01)

(52) U.S. Cl.
CPC ..... *A63B 55/008* (2013.01); *A63B 2055/002* (2013.01); *A63B 2209/02* (2013.01); *A63B 2210/50* (2013.01)
USPC ..... 206/315.6; 206/315.3

(58) Field of Classification Search
CPC ..... A63B 55/008
USPC ..... 206/315.3, 315.6
See application file for complete search history.

(56) References Cited

U.S. PATENT DOCUMENTS

| | | | | | |
|---|---|---|---|---|---|
| 3,534,795 | A * | 10/1970 | Wiedenmeier | 206/315.6 |
| 4,667,820 | A * | 5/1987 | Solheim | 206/315.6 |
| 4,703,851 | A * | 11/1987 | Stewert | 206/315.6 |
| 5,267,660 | A * | 12/1993 | Kwon | 211/70.2 |
| 5,988,379 | A * | 11/1999 | Yearous | 206/315.3 |
| 6,126,050 | A * | 10/2000 | Aliano, Jr. | 224/274 |
| 7,357,251 | B2 * | 4/2008 | Vosloo et al. | 206/315.6 |
| 7,909,215 | B2 | 3/2011 | McGuire et al. | |
| 8,201,686 | B2 * | 6/2012 | McGuire | 206/315.7 |
| 2006/0011682 | A1 | 1/2006 | Christensen et al. | |
| 2012/0085666 | A1 * | 4/2012 | McGuire | 206/315.3 |

* cited by examiner

*Primary Examiner* — Sue A Weaver
(74) *Attorney, Agent, or Firm* — Rebecca Hanovice; Michael A. Catania; Sonia Lari

(57) ABSTRACT

A golf bag having an internal strap channel is disclosed herein. The strap channel is affixed to a top collar, is located proximate a rear portion of the golf bag body, and extends from one side to the other side of the bag body. In some embodiments, the strap channel includes a center portion and two openings, which may further include rims made of rubber or another lightweight polymeric material.

12 Claims, 4 Drawing Sheets

GOLF BAG WITH STRAP-RECEIVING CHANNEL

The present application claims priority to U.S. Provisional Patent Application No. 61/694,393, filed on Aug. 29, 2012, the disclosure of which is hereby incorporated by reference in its entirety herein.

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf bag having an internal channel sized to receive a strap from a golf cart, golf trolley, or other golf bag-receiving or carrying device.

2. Description of the Related Art

Golf bags tend to become heavy, bulky, and awkward to carry when they are full of golfing equipment, so golfers often prefer to transport these golf bags via golf carts, trolleys, or other transportation devices while playing a round of golf. The bags can become unstable and fall off these carts or trolleys during use, however, so it is important to have a system in place that secures the bags to the transportation device. One such system is the retaining strap described in U.S. Patent Application No. 2006/0011682. This retaining strap is not ideal, however, because it adds weight to the bag and protrudes in an unsightly way from the bag. Another system is the strap disclosed in U.S. Pat. No. 5,871,183, which extends around the front portion of the golf bag. This strap also is not ideal, however, because it is visible to a golfer and can be unsightly.

As such, there is a need for a system to releasably but securely retain the golf bag on a cart or trolley so that the golf bag does not fall off the cart or trolley while it is in motion without adding excessive weight to the golf bag or detracting from the overall aesthetic look of the golf bag when it is connected to the cart or trolley.

BRIEF SUMMARY OF THE INVENTION

The golf bags of the present invention include an internal channel or slot sized to receive a strap extending from a golf cart or trolley.

One aspect of the present invention is a golf bag comprising a top collar comprising at least one divider, a strap channel, and a bag body, wherein the strap channel is disposed within and extends through the bag body. The strap channel may be sized to receive a strap attached to a golf bag transportation device. In some embodiments, the strap channel may comprise a center portion, a first opening, and a second opening. The first opening may be located on a first side of the center portion and the second opening may be located on a second side of the center portion, and the first and second openings may each comprise a rim, which may be covered with a rubber material. In some embodiments, the first and second rims may each be flush with a side of the bag body.

In some embodiments, the strap channel may be composed of a lightweight plastic material, a carbon composite material, or a lightweight metal alloy. The collar may comprise a plurality of dividers, and the bag body may be selected from the group consisting of a stand bag body, a carry bag body, and a cart bag body. In some embodiments, the strap channel may be located proximate a rear side of the bag body. In other embodiments, the top collar may comprise a lower edge, which may have one or more notches sized to receive at least a portion of the strap channel. In a further embodiment, the center portion of the strap channel may fit within the one or more notches. In some embodiments, the strap channel may be permanently affixed to the top collar. In other embodiments, the strap channel may be integrally formed with the top collar. In still other embodiments, the strap channel may be removably affixed to the top collar.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
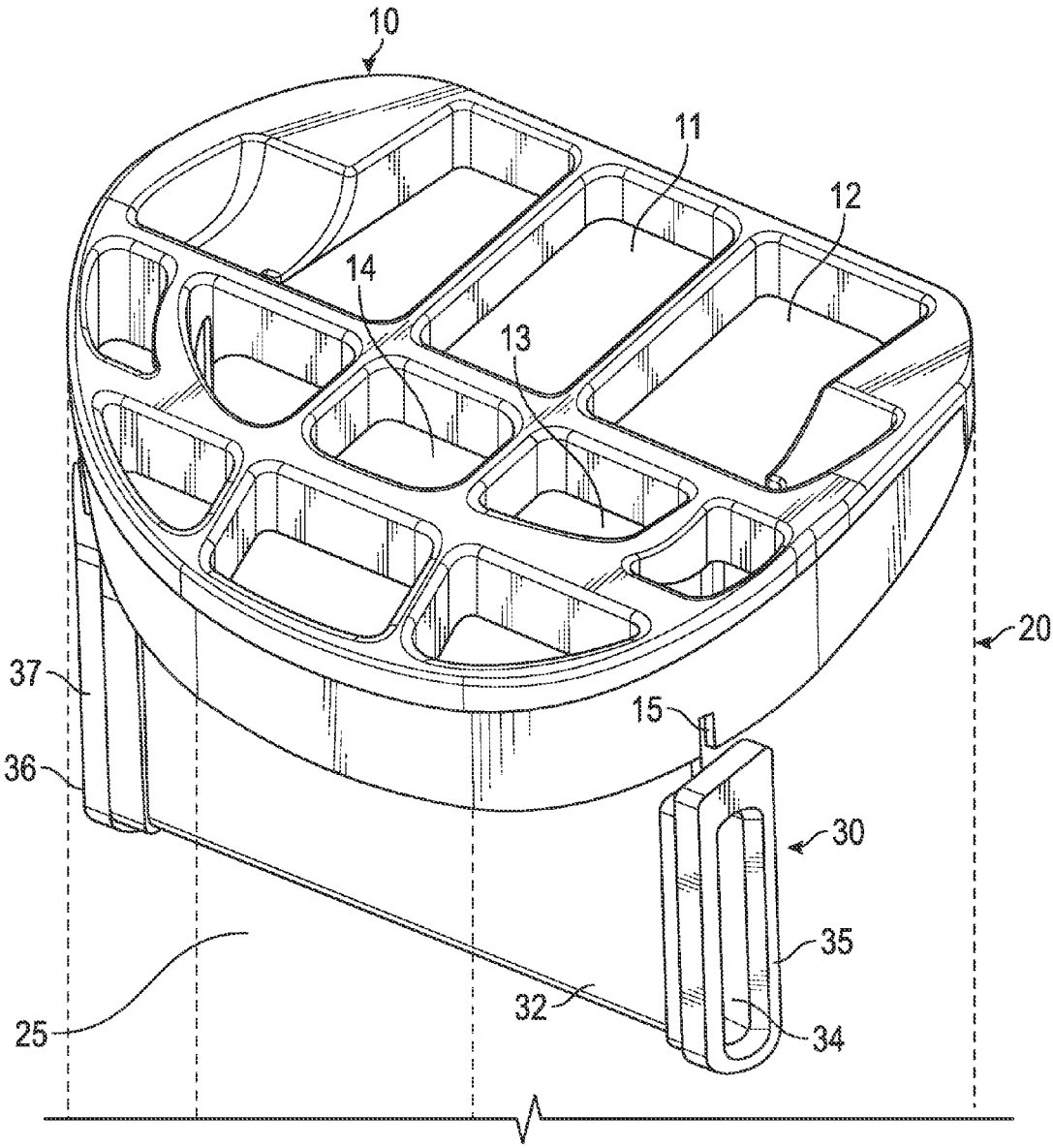
FIG. 1 is a rear perspective view of a golf bag including a first embodiment of the present invention.
Figure 2:
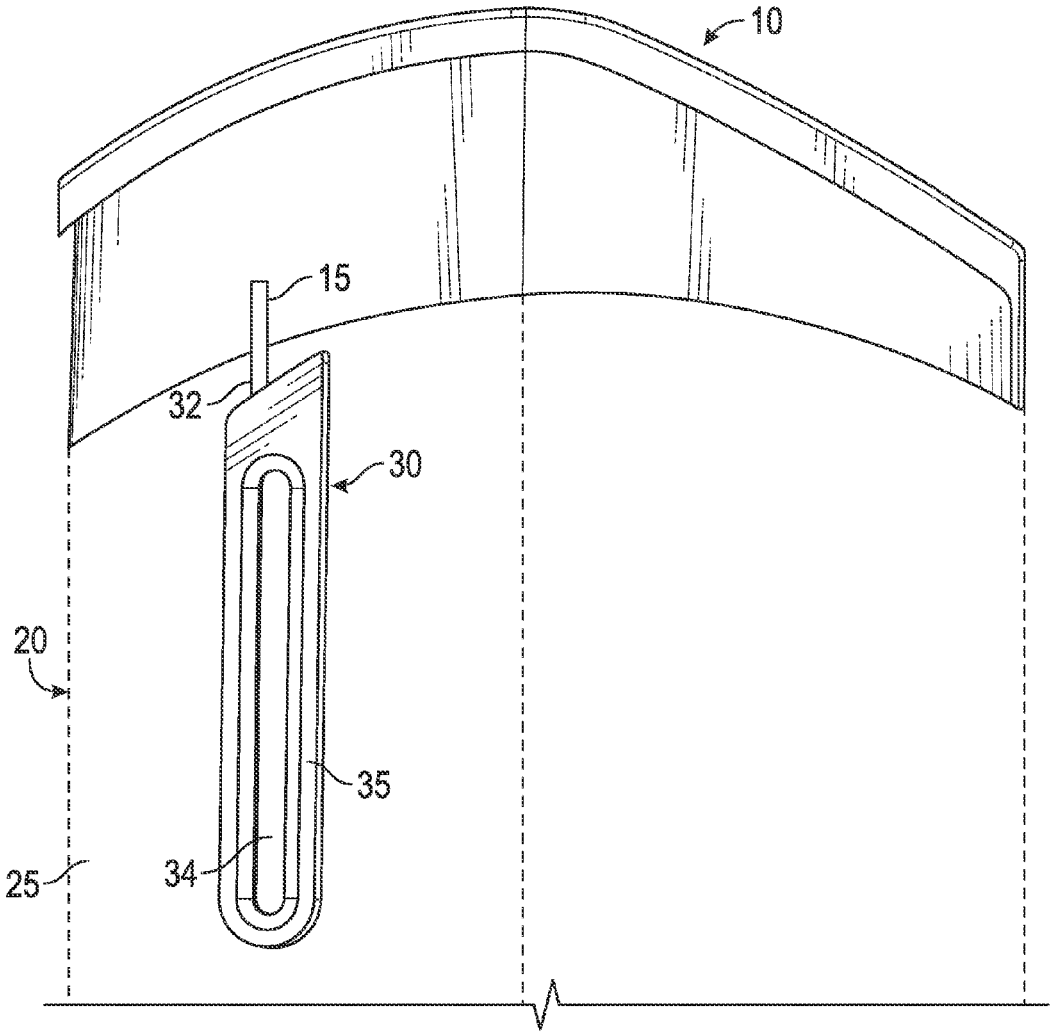
FIG. 2 is a side plan view of the embodiment shown in FIG. 1.
Figure 3:
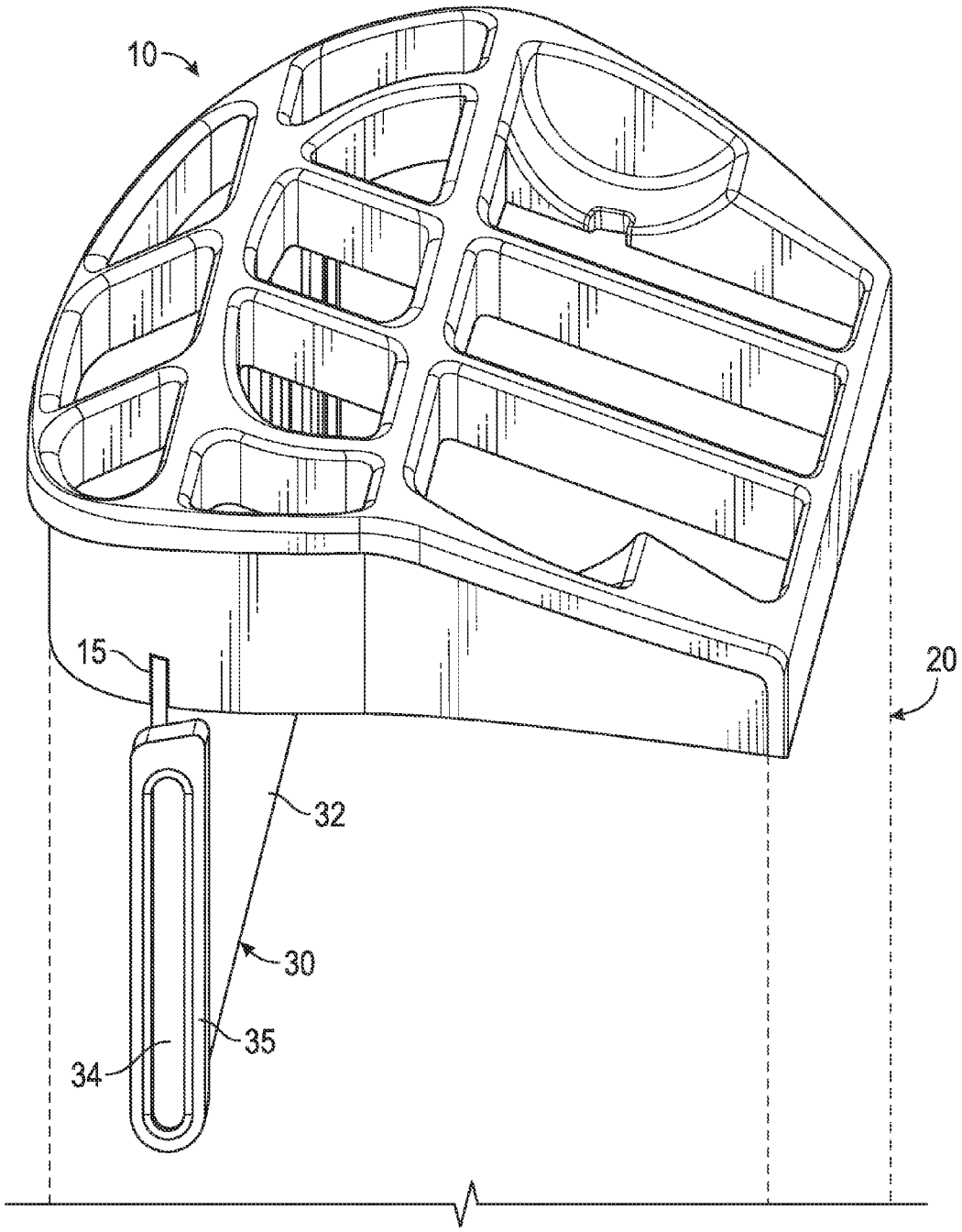
FIG. 3 is a side perspective view of the embodiment shown in FIG. 1.

The present invention is directed to a strap receiving channel located inside a golf bag that allows the bag to be securely and discreetly affixed to a bag transportation device such as a cart or trolley. The strap system of the present invention does not add significant weight to the overall bag structure and is hidden from the golfer's view during use.

A preferred embodiment of the present invention is shown in FIGS. 1-4. As shown in these Figures, a collar 10 having a plurality of dividers 11, 12, 13, 14 sized to receive one or more golf club shafts is formed from a sturdy and lightweight material, preferably plastic, composite, or a lightweight metal alloy. The collar 10 is disposed at an upper opening of a golf bag body 20, shown in dashed lines in the Figures. A strap channel 30 is disposed below the collar 10 and is received by one or more notches 15, 16 in a lower surface of the collar 10. The strap channel 30 is also formed from a sturdy and lightweight material, has a center portion 32 that extends from one side of the bag body 20 to another side of the bag body 20, and has two openings 34, 36, each with rims 35, 37 that are designed to be flush with the surface of the golf bag body 20 when the strap channel 30 is fully assembled with the collar 10 and the bag body 20.

The strap channel 30 preferably is permanently affixed to the collar 10 by any means known to a person of ordinary skill in the art, and may be integrally formed with the collar 10 during manufacture, but in other embodiments the strap channel 30 may be configured so that it may be easily removed from the collar 10. The strap channel 30 preferably is located proximate a rear portion 25 of the bag body 20 so that it is closer to the golf bag transportation device when a golf bag 60 including the present invention is loaded onto the transportation device.

Figure 4:
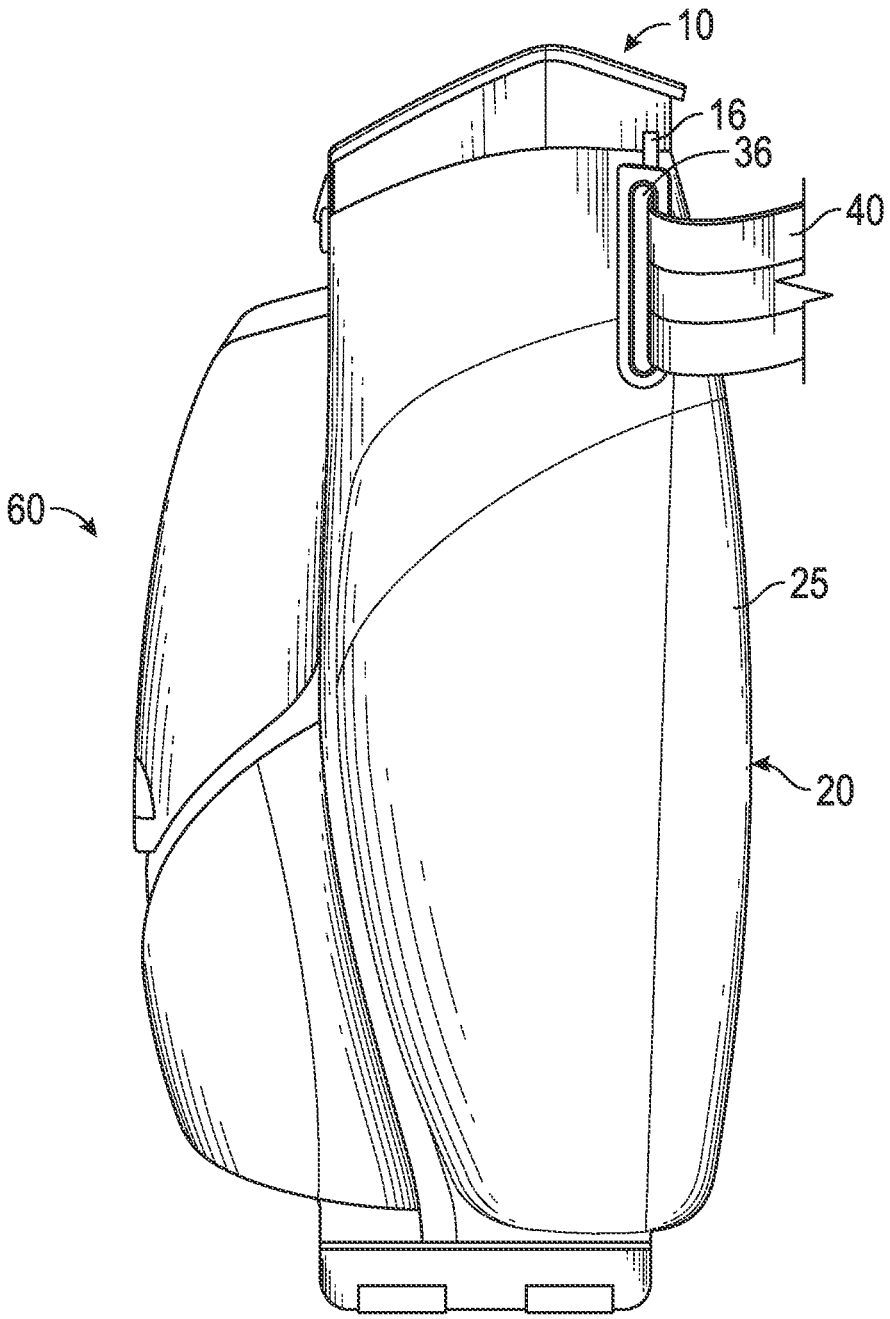
FIG. 4 is a side perspective view of the embodiment shown in FIG. 1 in combination with a golf bag and a strap from a golf cart.

FIG. 4 shows a golf bag 60 comprising the preferred embodiment of the present invention in combination with a strap 40, which may extend from any type of golf bag transportation device (not shown). The strap 40 is threaded through the openings 34, 36 and extends through the center portion 32 of the strap channel 30 to securely and removably fix the golf bag 20 to the transportation device.

The collar 10 and strap channel 30 configuration of the present invention can be used in connection with any kind of golf bag, including stand bags, carry bags, and cart bags, and can be made from any materials known to a person of ordinary skill in the art. For example, the strap channel 30 may be made of a lightweight but sturdy plastic and then the rims 35, 37 can be covered with a rubber material to increase the friction between the strap channel 30 and the golf cart strap 40 during use and better ensure that the golf bag 60 remains securely affixed to the transportation device. In other embodiments, the strap channel 30 may be made from a high strength carbon composite or a lightweight metal alloy.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf bag comprising:

a top collar comprising at least one divider;

a strap channel comprising a center portion, a first opening comprising a first rim, and a second opening comprising a second rim; and a bag body, wherein the strap channel is composed of a lightweight material and is disposed within and extends through the bag body;

wherein the first rim and the second rim are covered with a rubber material, and wherein the strap channel is disposed below, and is removably affixed to, the top collar.

2. The golf bag of claim 1, wherein the first opening is located on a first side of the center portion and the second opening is located on a second side of the center portion.

3. The golf bag of claim 1, wherein the strap channel is composed of a plastic material.

4. The golf bag of claim 1, wherein the collar comprises a plurality of dividers.

5. The golf bag of claim 1, wherein the strap channel is located proximate a rear side of the bag body.

6. The golf bag of claim 1, wherein the top collar comprises a lower edge, and wherein the lower edge comprises at least one notch sized to receive at least a portion of the strap channel.

7. The golf bag of claim 6, wherein the at least one notch comprises a plurality of notches.

8. The golf bag of claim 6, wherein the center portion of the strap channel fits within the at least one notch.

9. The golf bag of claim 1, wherein the bag body is a cart bag body.

10. The golf bag of claim 1, wherein the strap channel is sized to receive a strap attached to a golf bag transportation device.

11. The golf bag of claim 1, wherein the strap channel is composed of a carbon composite material.

12. The golf bag of claim 1, wherein the strap channel is composed of a metal alloy.

* * * * *